US007197114B2

(12) United States Patent
Le-Pierrard et al.

(10) Patent No.: US 7,197,114 B2
(45) Date of Patent: Mar. 27, 2007

(54) X-RAYS EMITTER AND X-RAY APPARATUS AND METHOD OF MANUFACTURING AN X-RAY EMITTER

(75) Inventors: Caroline Le-Pierrard, Versailles (FR); Yves Serughetti, Paris (FR); Joel Beudard, Bievres (FR)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 163 days.

(21) Appl. No.: 10/668,541

(22) Filed: Sep. 23, 2003

(65) Prior Publication Data

US 2005/0041780 A1 Feb. 24, 2005

(30) Foreign Application Priority Data

Sep. 26, 2002 (FR) ..... 02 11919

(51) Int. Cl.
*H01J 35/20* (2006.01)
*H01J 35/32* (2006.01)
*H01J 35/10* (2006.01)

(52) U.S. Cl. ..... 378/123; 378/121; 378/144

(58) Field of Classification Search ..... 378/101, 378/117, 119, 121, 123, 125, 136, 144
See application file for complete search history.

(56) References Cited

U.S. PATENT DOCUMENTS

| | | | | |
|---|---|---|---|---|
| 4,024,424 | A * | 5/1977 | Eggelsmann et al. | 378/131 |
| 4,126,803 | A | 11/1978 | Bader et al. | 313/55 |
| 4,413,356 | A * | 11/1983 | Hartl | 378/132 |
| 6,362,415 | B1 * | 3/2002 | Snyder et al. | 174/15.1 |
| 6,556,654 | B1 * | 4/2003 | Hansen et al. | 378/101 |

FOREIGN PATENT DOCUMENTS

| | | | |
|---|---|---|---|
| EP | 993238 | A1 * | 4/2000 |
| GB | 2002598 | | 2/1979 |
| WO | 0118842 | | 3/2001 |

* cited by examiner

*Primary Examiner*—Edward J. Glick
*Assistant Examiner*—Irakli Kiknadze
(74) *Attorney, Agent, or Firm*—Cantor Colburn LLP

(57) ABSTRACT

An X-ray emitter and an X-ray apparatus and method of manufacturing an x-ray emitter. The emitter has an anode, a cathode, and a vacuum evacuated body in which the anode and the cathode are placed. The body has an opening and a high-voltage connector placed in the opening, the connector closing off the opening in a vacuum-tight manner, thereby subjecting the connector to a vacuum on one side of the cathode and to ambient air on an opposite side.

40 Claims, 2 Drawing Sheets

X-RAYS EMITTER AND X-RAY APPARATUS AND METHOD OF MANUFACTURING AN X-RAY EMITTER

CROSS-REFERENCE TO RELATED APPLICATIONS

This application claims the benefit of a priority under 35 USC 119(a)–(d) to French Patent Application No. 02 11919 filed Sep. 26, 2002, the entire contents of which are hereby incorporated by reference.

BACKGROUND OF THE INVENTION

The present invention relates to the field of X-rays and more particularly, to X-ray tubes or X-ray emitters and an X-ray apparatus.

An X-ray tube mounted, for example, in a radiological imaging apparatus, comprises a cathode and an anode, both being enclosed in an evacuated sealed envelope in order to provide electrical insulation between these two electrodes. The cathode produces an electron beam that is received by the anode over a small surface constituting a focus from which the X-rays are emitted. The envelope is generally transparent to X-rays. The X-ray assembly or tube comprising the cathode, the anode and the envelope is in its turn contained in a enclosure which is opaque to X-rays, except for a part located facing the X-ray beam emitted by the anode, which comprises a window made of a material transparent to X-rays. A gap between the transparent envelope and the opaque enclosure is filled by oil providing electrical insulation and cooling the X-ray source.

On application of a high supply voltage by a generator to terminals of the cathode and the anode, a current called the anode current is established in the circuit through the generator that produces the high supply voltage. The anode current passes through a space between the cathode and the anode in the form of an electron beam that bombards the focus.

To obtain a high-energy electron beam, the electrons are accelerated by an intense electric field produced between the cathode and the anode. To this end, the anode is brought to a very high positive potential with respect to the cathode. This potential may exceed 150 kV.

The cathode assembly comprises elements that are at the same voltage as the cathode, in general an arm or a stand supporting the cathode and a central part supporting the arm and in contact with the end of the envelope away from the anode. A plurality of parallel pins passes through the envelope in a sealed manner, and is axially oriented. One of the pins may be coaxial with the rotating shaft of the anode and the others parallel. The pins project into the internal space of the enclosure and are bathed in oil. The pins are connected to a high-voltage supply via a through hole formed in the enclosure and forming the female part of a connection means capable of cooperating with a corresponding part. An X-ray tube is disclosed in FR A 2 809 277.

While the known X-ray tube or X-ray emitter is satisfactory it is still heavy and is relatively bulky.

BRIEF DESCRIPTION OF THE INVENTION

An embodiment of the present invention provides a compact and lightweight X-ray tube or X-ray emitter. An embodiment of the present invention is a radiological imaging apparatus having a compact and lightweight X-ray tube or X-ray emitter.

According to one embodiment of the invention, the X-ray emitter comprises an anode, a cathode and a body in which the anode and the cathode are placed, where the body made to be vacuum-tight. The body comprises an opening in which a high-voltage connector is placed, the connector closing off the opening in a vacuum-tight manner, thereby being subjected to the vacuum on the side of the cathode and to ambient air on the opposite side. Thus it is possible to have an X-ray tube with no enclosure, the connector being directly fastened to the body supporting the anode.

An embodiment of the invention also relates to an X-ray apparatus comprising an X-ray emitter, an X-ray receiver capable of supplying at the output a signal representative of an object placed in the path of the X-rays, and a support for the X-ray emitter.

An embodiment of the invention also relates to a method of manufacturing an X-ray emitter having a body capable of being made vacuum-tight and comprising forming an opening in the body, a body in which an anode and a cathode are placed, in which a high-voltage connector is placed and fastened into the opening, the connector closing off the opening in a vacuum-tight manner, and the body is evacuated so that the body is subjected to the vacuum on the side of the cathode and to ambient air on the opposite side.

BRIEF DESCRIPTION OF THE DRAWINGS

The present invention and embodiments thereof will be better understood on reading the detailed description of one embodiment taken by way of example which is in no way limiting and illustrated by the appended figures, in which.

DETAILED DESCRIPTION OF THE INVENTION

Figure 1:
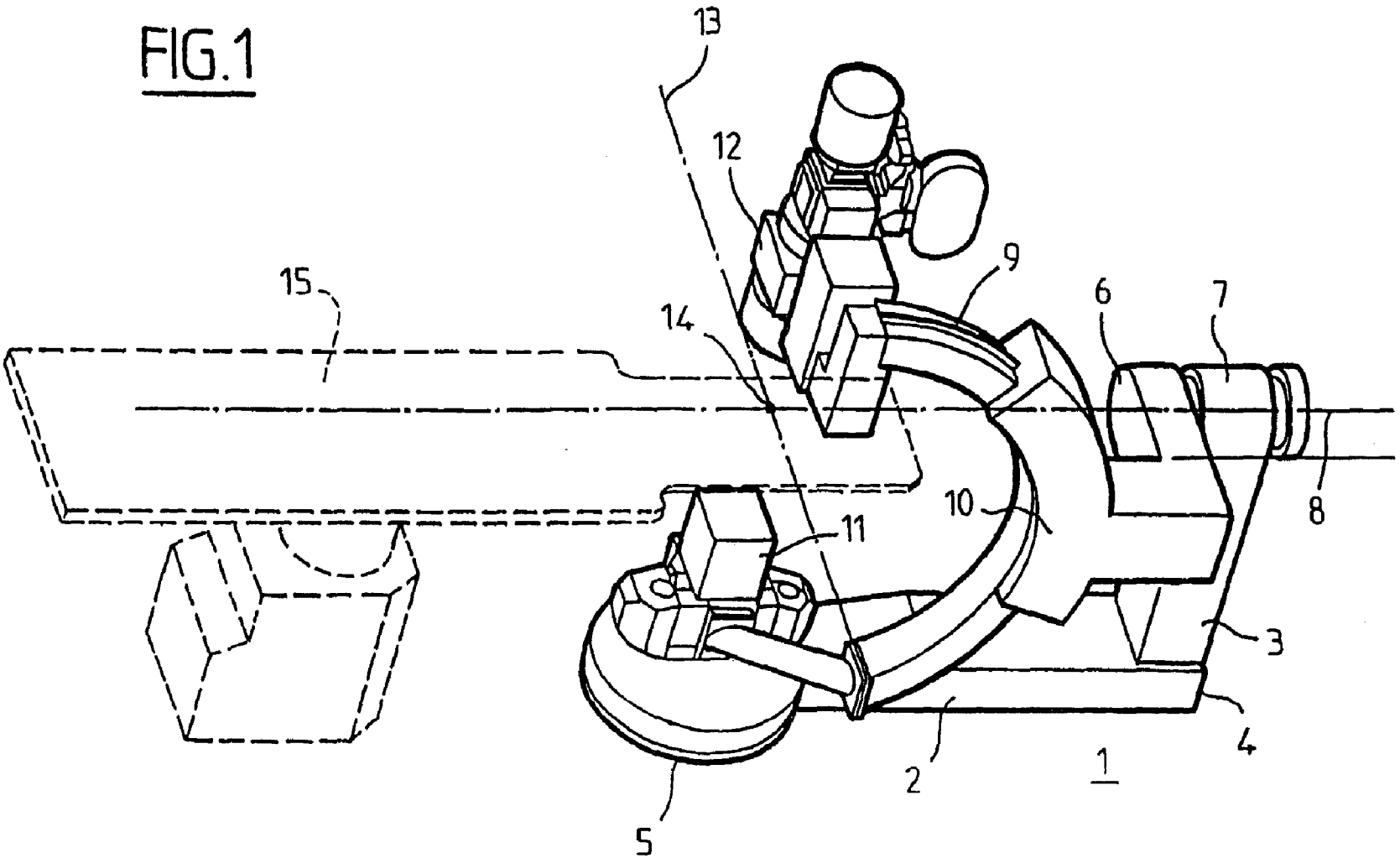
FIG. 1 is a perspective view of a radiology apparatus having three axes which may be equipped with an X-ray tube.

As shown in FIG. 1, the radiology apparatus comprises an L-shaped stand 1, with a substantially horizontal base 2 and a substantially vertical support 3 fastened to one end 4 of the base 2. At the opposite end 5, the base 2 has an axis of rotation parallel to the support 3 and about which the stand is capable of rotating. A support arm 6 is fastened by means of a first end to the top 7 of the support 3, so that it can rotate about an axis 8. The support arm 6 may have the shape of a bayonet. A C-shaped circular arm 9 is held by means of another end 10 of the support arm 6. The C-shaped arm 9 is capable of sliding rotationally about an axis 13 with respect to the end 10 of the support arm 6.

The C-shaped arm 9 supports an X-ray emitter 11 and an X-ray detector 12 in diametrically opposed positions facing each other. The detector 12 may comprise a flat detecting surface. The direction of the X-ray beam is determined by a straight line joining a focal point of the emission means 11 to the center of the flat surface of the detector 12. The axis of rotation of the stand 1, the axis 8 of the support arm 6 and the axis 13 of the C-shaped arm 9 intersect at a point 14 called the isocenter. In the mean position, these three axes are mutually perpendicular. The axis of the X-ray beam also passes through the isocenter 14.

Figure 2:
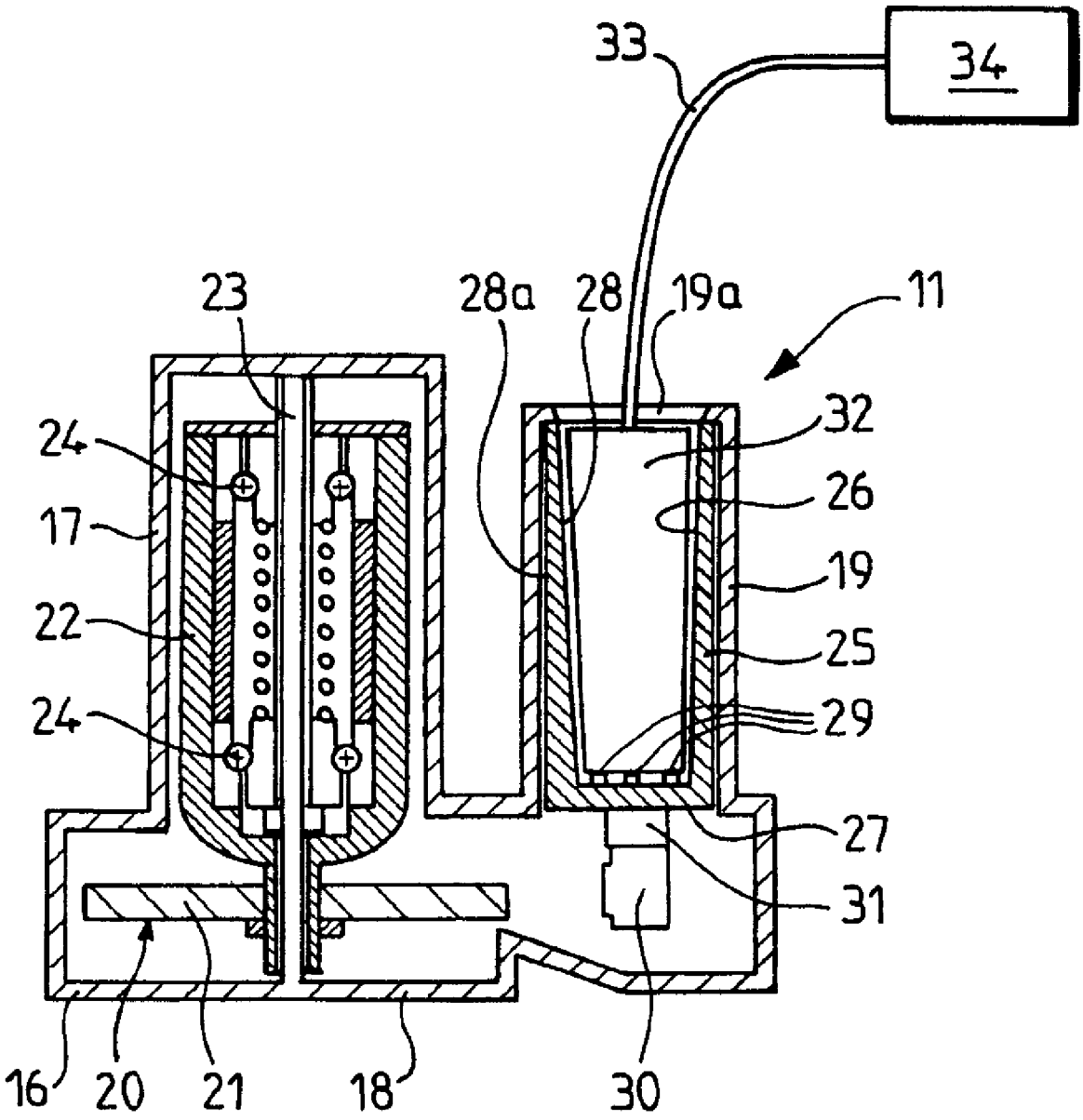
FIG. 2 is a view of an X-ray tube according to one embodiment of the invention in section along the axis of rotation of the anode.

A table 15 is provided to receive an object to be examined, such as a patient. The table 15 has a longitudinal orientation aligned with the axis 8 in the rest position. The X-ray emitter 11 is illustrated in more detail in FIG. 2.

The X-ray emitter 11 comprises an envelope or body 16 made from a metal, such as stainless steel, for example of the 304L type. The body 16 comprises a cylindrical portion 17, one end of which is closed, a central portion 18 connected to the open end of the cylindrical portion 17 and another cylindrical portion 19 having two open ends, one connected to the central portion 18 and the other, 19*a*, forming an opening or free end. The cylindrical portions 17 and 19 may have parallel axes and be placed on the same side of the central portion 18.

The X-ray emitter further comprises an anode assembly 20 provided with an anode 21 in the shape of a disc, a rotating part 22 supporting the anode 21 and a non-rotating part 23 supporting the rotating part 22 and being fastened at its respective ends to the body 16. The anode 21 is placed in the central portion 18 of the body 16 and the rotating 22 and non-rotating 23 parts are mainly placed in the cylindrical portion 17 of the body 16. Alternatively, it would be possible to design a non-rotating part fastened at only one of its ends to the body 16. Bearings 24 are placed between the non-rotating part 23 and the rotating part 22 in order to allow high-speed rotation of the rotating part 22.

The electrical structure of the rotating 22 and non-rotating 23 parts and the electrical connection of the anode are well known and are not further described.

The X-ray emitter further comprises a connector 25 designed to withstand high voltages of several tens or even hundreds of kilovolts and made from an insulating material such as an oxide, and more particularly a ceramic, especially an aluminum-based ceramic, for example based on alumina or aluminum nitride. Alumina is an example of an electrically insulating oxide. The connector 25 forms a female part of a connection assembly that also comprises a male part (not shown). Alternatively, the connector may form the male part of a connection assembly, or more generally, part of a connection assembly. The connector 25 has a generally cylindrical external shape and is placed in a generally cylindrical portion 19 of the body 16 to which it is securely fastened in a leak-tight manner. The connector 25 could have a conical or even an annular corrugated external shape. The connector 25 has a frusto-conical concavity 26 designed to accommodate the male part of the connection assembly by passing it through the opening 19*a* of the cylindrical portion 19. The concavity 26 could be cylindrical. More specifically, the connector 25 comprises a radial bottom 27 and a tubular wall 28 fastened to the bottom 27 and in sealed contact with the cylindrical portion 19 by means of its external wall 28*a*. The connector 25 can be fastened to the cylindrical portion 19 by brazing. The connector 25 further comprises four electrically conducting pins 29, only three of which are visible in the figure, placed in the bottom of the concavity 26, on the radial wall 27, and which ensure electrical energy is transmitted. The pins 29 may be nickel-based.

The cathode 30 is fastened to the inside of the radial wall 27, at the same axial level as the anode 21. For good relative positioning of the cathode 30 with respect to the anode 21, a short spacer 31 may be placed between the cathode 30 and the connector 25. The spacer 31 and the cathode 30, supported by the connector 25, project into the central portion 18 of the body 16 while the radial wall 27 of the connector 25 lies flush with the central portion 18 of the body 16.

The concavity 26 of the connector 25 is subject to atmospheric pressure and to ambient air. The inside of the radial wall 27 is subject to the extremely low pressure, i.e., a vacuum, in the field of X-ray generators.

The X-ray emission tube can be manufactured as follows. A body that can be made vacuum-tight and comprising an opening is formed, an anode and a cathode being placed in the body. A high-voltage connector is placed and fastened into the opening. The connector closes off the opening in a vacuum-tight manner. The body is evacuated such that the body is subjected to the vacuum on the cathode side and to atmospheric pressure and to ambient air on the opposite side.

In operation of the X-ray tube, the body 16 is connected to earth (ground) and the pins 29 to the electrical contacts (not shown) of a male part 32 of a connection assembly of one end of a cable 33 connected to a high-voltage generator 34. A stator of an electric motor can be placed around the cylindrical portion 17 of the body 16, capable of generating the magnetic fields needed to rotate the rotating part 22 of the anode assembly 20, the rotating part 22 forming a rotor of an electric motor. Thus it is possible to rotate the anode 21 at high speed while keeping it earthed (grounded) by means of electrical connection to the body 16 itself connected to earth (ground), an electron beam being generated as a result of the difference in electrical potential between the earthed (grounded) anode 21 and the cathode 30 subjected to the high supply voltage.

The body 16, which may directly support the connector 25, provides the electrical connection for the anode to earth (ground), the mechanical support for the anode assembly 20 and for the connector 25 that supports the cathode 30, the leak-tightness against X-rays by virtue of the metal wall, which for example can be made of stainless steel, and which provides sufficient opacity to X-rays and by virtue of the connector 25 which also provides sufficient opacity to X-rays, the vacuum-tightness in cooperation with the connector 25 and the mechanical strength against forces exerted by the external atmospheric pressure while the inside of the body is subjected to the vacuum. Thus, it is possible to benefit from a lightweight X-ray tube of smaller overall size, free from the lead usually used and from the insulating oil, two materials that cause problems for the environment.

The X-ray tube thus obtained is therefore lighter, smaller and more environmentally friendly while at the same time being adaptable for various types of X-ray machines in the medical or industrial field.

The cathode may be supported by the connector. It is possible to do without a cathode support stand or arm. The connector then virtually takes the place previously occupied by the cathode stand, which contributes to a substantial reduction in the overall size of the X-ray tube. The cathode may be supported by the connector by means of an intermediate spacer. The intermediate spacer is of small length compared with a conventional cathode stand.

In one embodiment of the invention, the body is made of metal. By way of example, the body may be made of stainless steel.

The connector may thus be supported by a portion of the body that is relatively opaque to X-rays.

The body comprises a stainless steel part directly supporting the connector.

The body comprises materials having atomic numbers less than 82. Since the body is made of metal, an X-ray tube with no lead, a contaminating element that is desirable to remove, can be used. The thickness of the body walls can be adapted according to the opacity to X-rays of the metal from which it is made and to the location of X-ray leakage.

In one embodiment of the invention, the body comprises a cylindrical portion forming the opening, the connector being placed and fastened into the cylindrical portion.

The connector may be made from a ceramic. The connector is thus suitable firstly for the mechanical stresses due to the vacuum inside the X-ray tube and to the atmospheric pressure outside the X-ray tube, secondly for the actual vacuum sealing, thirdly for sufficient opacity to the X-rays, and fourthly for high electrical insulation and for appropriate thermal resistance. The term "vacuum" is understood to mean the vacuum called a "secondary" vacuum with a pressure of between 10-3 and 10-9 torr.

The connector can be made from an electrically insulating oxide. The connector may comprise aluminum, for example in the form of alumina, or magnesium, for example in the form of magnesia, or more generally, electrically insulating oxides. Alternatively, the connector may be based on a metal nitride, especially an aluminum nitride.

The weight of X-ray tube is appreciably reduced, by about 30 to 50% compared with a conventional X-ray tube having the same power. The overall size o the X-ray tube is also reduced, which in the case of X-ray tubes supported by articulated arms, may favor a reduction in the size of the arms and allow greater freedom of angular positioning with respect to an object or patient or else greater freedom of positioning in an industrial environment in difficult-to-reach regions. The reduction in weight of the X-ray tube also makes it possible to reduce the dimensions of the motor drive provided for moving it and to benefit from improved position control.

Conventionally, the body comprises a glass cathode neck fastened to the rest of the metal body. The metal body makes it possible to reduce X-ray leakage and therefore to put an end to the use of lead in the device. The body is completely made from metal and assembled by welding elementary parts.

Moreover, directly fastening the connector to the body rather than to the enclosure, as in conventional devices, makes it possible to dispense with the use of insulating mineral oil which is usually placed between the X-ray tube body and the enclosure and therefore also to dispense with the enclosure. In other words, the body not only provides the function of supporting the connector but also the radiation protection function usually provided by the enclosure. The X-ray emitter therefore has a simpler structure than the known devices and may have no contaminating elements, especially dielectric oil or lead, while at the same time having a reduced mass and a small overall size.

One skilled in the art may make or propose various modifications to the structure and/or steps and/or manner and/or way and/or result without departing from the scope and extent of the invention and equivalents thereof.

What is claimed is:

1. An X-ray emitter comprising:

an anode;

a cathode;

a vacuum evacuated body in which the anode and the cathode are placed;

a non-rotating member fastened to the body and forming a stationary axis of rotation;

a rotating member supported by and disposed about the non-rotating member, the rotating member rotatable about the non-rotating member via bearings, the anode being supported by the rotating member and rotatable about the axis of rotation;

an opening in the body; and a high-voltage connector placed in the opening, the connector closing off the opening in a vacuum-tight manner, the high-voltage connector connected to the cathode and configured to connect to a high-voltage generator;

wherein the connector is subjected to a vacuum on the side of the cathode and to ambient air on the opposite side;

wherein the outside of the vacuum evacuated body is subjected to atmospheric pressure and ambient air;

wherein the anode is configured to connect to ground potential and is rotationally operable at high speed while the anode is connected to ground potential; and wherein the anode comprises a rotatable disc, and the cathode is disposed in a plane defined by the rotatable disc.

2. The emitter according to claim 1 wherein the cathode is supported by the connector.

3. The emitter according to claim 2 wherein the cathode is supported by the connector by means of an intermediate spacer.

4. The emitter according to claim 3 wherein the body is made of metal.

5. The emitter according to claim 4 wherein the connector is made from a ceramic.

6. The emitter according to claim 4 wherein the connector is made from an electrically insulating oxide.

7. The emitter according to claim 3 wherein the body comprises a material having an atomic number less than 82.

8. The emitter according to claim 7 wherein the connector is aluminum based.

9. The emitter according to claim 7 wherein the connector is aluminum nitride-based.

10. The emitter according claim 3 wherein the body comprises a cylindrical portion forming the opening, the connector being placed and fastened into the cylindrical portion.

11. The emitter according to claim 3 wherein the connector is made from a ceramic.

12. The emitter according to claim 2 wherein the body is made of metal.

13. The emitter according claim 12 wherein the body comprises a cylindrical portion forming the opening, the connector being placed and fastened into the cylindrical portion.

14. The emitter according to claim 12 wherein the connector is made from a ceramic.

15. The emitter according to claim 3 wherein the connector is made from an electrically insulating oxide.

16. The emitter according to claim 12 wherein the connector is made from an electrically insulating oxide.

17. The emitter according to claim 2 wherein the body comprises a material having an atomic number less than 82.

18. The emitter according to claim 17 wherein the connector comprises aluminum.

19. The emitter according claim 2 wherein the body comprises a cylindrical portion forming the opening, the connector being placed and fastened into the cylindrical portion.

20. The emitter according to claim 2 wherein the connector is made from a ceramic.

21. The emitter according to claim 2 wherein the connector is made from an electrically insulating oxide.

22. The emitter according to claim 1 wherein the body is made of metal.

23. The emitter according to claim 22 wherein the body comprises a material having an atomic number less than 82.

24. The emitter according to claim 23 wherein the connector is aluminum based.

25. The emitter according to claim 23 wherein the connector is aluminum nitride-based.

26. The emitter according claim 22 wherein the body comprises a cylindrical portion forming the opening, the connector being placed and fastened into the cylindrical portion.

27. The emitter according to claim 22 wherein the connector is made from a ceramic.

28. The emitter according to claim 22 wherein the connector is made from an electrically insulating oxide.

29. The emitter according to claim 1 wherein the body comprises a material having an atomic number less than 82.

30. The emitter according to claim 5 wherein the connector is made from an electrically insulating oxide.

31. The emitter according to claim 5 wherein the connector comprises aluminum.

32. The emitter according claim 1 wherein the body comprises a cylindrical portion forming the opening, the connector being placed and fastened into the cylindrical portion.

33. The emitter according to claim 1 wherein the connector is made from a ceramic.

34. The emitter according to claim 1 wherein the connector is made from an electrically insulating oxide.

35. The emitter of claim 1, wherein:

the connector has a generally cylindrical external wall that is securely fastened in a vacuum-tight manner to a generally cylindrical portion of the vacuum evacuated body.

36. The emitter of claim 1, wherein: the anode is electrically connected to the body, and the body is configured to connect to ground potential.

37. An X-ray apparatus comprising:

an X-ray emitter comprising:

an anode;

a cathode;

a vacuum evacuated body in which the anode and the cathode are placed;

a non-rotating member fastened to the body and forming a stationary axis of rotation;

a rotating member supported by and disposed about the non-rotating member, the rotating member rotatable about the non-rotating member via bearings the anode being supported by the rotating member and rotatable about the axis of rotation;

an opening in the body; and a high-voltage connector placed in the opening, the connector closing off the opening in a vacuum-tight manner, the high-voltage connector connected to the cathode and configured to connect to a high-voltage generator;

wherein the connector is subjected to a vacuum on the side of the cathode and to ambient air on the opposite side;

wherein the outside of the vacuum evacuated body is subjected to atmospheric pressure and ambient air;

means for receiving the X-rays and capable of supplying an output signal representative of an object placed in the path of the X-rays;

wherein the anode is configured to connect to ground potential and is rotationally operable at high speed while the anode is connected to ground potential; and wherein the anode comprises a rotatable disc, and the cathode is disposed in a plane defined by the rotatable disc.

38. The apparatus according to claim 37 wherein the connector is made of an insulating oxide.

39. A method of manufacturing an X-ray emitter comprising:

providing a body capable of being made vacuum-tight, the body having a non-rotating member fastened thereto and forming a stationary axis of rotation;

forming an opening in the body;

placing an anode and a cathode in the body, the anode being supported by a rotating member, the rotating member being placed in the body about the non-rotating member, the anode comprising a rotatable disc, the cathode being placed in a plane defined by the rotatable disc;

placing a high-voltage connector in the body, the high-voltage connector connected to the cathode and configured to connect to a high-voltage generator;

fastening the connector into the opening, the connector closing off the opening in a vacuum-tight manner; and evacuating the body so tat the body is subjected to a vacuum on the side of the cathode and to atmospheric pressure and ambient air on the opposite side;

wherein the anode is configured to connect to ground potential and is rotationally operable at high speed while the anode is connected to ground potential.

40. The method according to claim 39 wherein the connector is made from an electrically insulating oxide.

* * * * *

UNITED STATES PATENT AND TRADEMARK OFFICE

CERTIFICATE OF CORRECTION

PATENT NO. : 7,197,114 B2
APPLICATION NO. : 10/668541
DATED : February 27, 2007
INVENTOR(S) : Le-Pierrard et al.

It is certified that error appears in the above-identified patent and that said Letters Patent is hereby corrected as shown below:

Column 5:
Lines 35-36, after "bis(4-aminocyclohexyl)methane", delete "norbomanedimethylamine" and insert therefor --norbornanedimethylamine--;

Column 13 and 14:
Table 2, delete "Multi-Axial Imact Loss" and insert therefor --Multi-Axial Impact Loss--;

Column 17:
Line 32, after "weight", delete "ofpoly" and insert therefor --of poly--;
Line 45, after "temperature", delete "of330" and insert therefor --of 330--.

Signed and Sealed this

Eighteenth Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 7,197,114 B2
APPLICATION NO. : 10/668541
DATED : March 27, 2007
INVENTOR(S) : Caroline Le-Pierrard et al.

It is certified that error appears in the above-identified patent and that said Letters Patent is hereby corrected as shown below:

This certificate supersedes the Certificate of Correction issued September 18, 2007. The certificate should be vacated since no Certificate of Correction was granted for this patent number.

Signed and Sealed this

Fifth Day of February, 2008

JON W. DUDAS
*Director of the United States Patent and Trademark Office*